US005536004A

United States Patent [19]

Wiseman et al.

[11] Patent Number: 5,536,004

[45] Date of Patent: Jul. 16, 1996

[54] BATTING TRAINING DEVICE

[76] Inventors: Katherine O. Wiseman, 6781 FM 1102, New Braunfels, Tex. 78132; Anne O. Christian, 17309 Sandy Cliffs, Houston, Tex. 77090

[21] Appl. No.: 523,013

[22] Filed: Sep. 1, 1995

[51] Int. Cl.[6] ..... A63B 69/00

[52] U.S. Cl. ..... 273/26 R

[58] Field of Search ..... 273/26 R, 26 A, 273/26 E

[56] References Cited

U.S. PATENT DOCUMENTS

| | | | |
|---|---|---|---|
| 4,463,950 | 8/1984 | Elkin | 273/26 R |
| 4,886,267 | 12/1989 | Licciardi et al. | 273/26 R |
| 4,932,656 | 6/1990 | Pierce | 273/26 R |
| 5,076,580 | 12/1991 | Lang | 273/26 R |
| 5,330,176 | 7/1994 | Cagney, Jr. | 273/26 R |

*Primary Examiner*—William H. Grieb
*Attorney, Agent, or Firm*—Gunn, Lee & Miller

[57] ABSTRACT

A simple training device to teach a baseball batter to utilize a proper batting position. The training device is a mat marked with a first indicia designating home plate and a plurality of second indicia showing sequential segments for the batter to place his feet. The mat may be used alone to achieve a proper batting stance and proper foot positioning in relation to home plate or with at least one measuring means for measuring a point located in the strike zone of the batter identifying the height of a level swing of the bat. This measured specific distance correlates to a proper distance from home plate the batter should position himself to hit the ball with the "power zone" of the bat with a full arm extension of the leading arm. The training device teaches the novice batter the most advantageous position to consistently hit the ball with the bat.

19 Claims, 4 Drawing Sheets

BATTING TRAINING DEVICE

BACKGROUND OF THE INVENTION

1. Field of The Invention

The present invention relates generally to training devices to teach proper positioning of a batter in relation to home plate, the pitcher and to the ball. The present invention relates to a training device for teaching a novice baseball batter the proper batting position from which to hit a ball with a bat. The present invention specifically relates to a training device for teaching a novice batter where to place his or her feet in relation to home plate. The training device of the present invention particularly allows the batter to determine a point located in his or her strike zone and then place his or her feet on specific correlated markings on the device that are at a specified distance from home plate so that he or she will have the opportunity to hit the ball with a level swing of the bat with the "power zone" of the bat using a full arm extension of the leading arm.

2. Background Information

The sport of baseball is played by large numbers of children and adults all over the world and introduction to the sport is begun at a very young age; that is, as early as five or six years old. To provide an easy introduction to the sport, a modified form of baseball for young children, known as Tee Ball is played. In Tee Ball, the ball is hit off of a Tee, which has a home plate shaped base from which a two piece telescoping member extends perpendicularly upward. However, even though Tee Ball makes it easier for a novice batter to hit the ball off of the Tee rather than hit a ball pitched by a pitcher or coach, it is still difficult for a novice batter to know where to stand in relation to home plate, in relation to the pitcher and to make good contact with the ball.

Batting training devices are known in the prior art but none of these devices provide an easy to use device which allows the batter to select the optimal foot position in relation to home plate and in relation to each other using sequential foot positions allowing for incremental adjustments without any mechanical manipulations. The proper foot positioning achieved with the present device results in a batter having a proper batting stance with the correct width and with the feet parallel to each other and squared to home plate. In a further embodiment, the training kit of the present invention, in addition to teaching a proper batting stance with feet squared to home plate, positions each individual batter to achieve a level swing with the bat by easily correlating a measurement of a point in the strike zone of the batter with the positioning of the feet of the batter at a proper distance from home plate.

U.S. Pat. No. 4,932,656 discloses a rectangular panel with a raised element along an end edge, which acts as a positioning indicator for the trailing or rear foot, and with a set of progressive numerical indicia along two side edges of the device. This device is placed a bat's length from the outside edge of home plate and then the length of the bat is utilized to determine the position for placing colored VELCRO markers along parallel VELCRO strips mounted along the sides of the numerical indicia to show the position of the trailing foot, the leading foot, the striding foot and the head of the batter. This device basically uses a bat to determine the proper position of the batter's feet during the swing both before and after the stride is taken.

U.S. Pat. No. 4,463,950 discloses another batting practice trainer having a baseball home plate with extended side borders which are to define the strike zone by having home plate indicated by a white color and the extended side edges indicated by fluorescent orange. The batter is to stand near the outside edge of one of the side borders but not on the border, to position the batter and define the strike zone. This trainer defines the same strike zone for every batter regardless of the age and size of the batter.

An apparatus for use with a batting Tee is disclosed in U.S. Pat. No. 5,076,580. This apparatus contains a home plate which is attached to a foot element by a telescoping connector. One end of the telescoping connector has a hole allowing it to be placed over the top of the batting Tee allowing the device to swivel around the batting Tee to change the batter's stance. This apparatus requires manual adjustment of the telescoping connectors between the batting Tee and the foot elements and between each foot of the foot element, which may require picking this apparatus up off of the ground to do so. Additionally, there does not appear to be any easy mechanism to lock the telescoping elements into position which may result in the telescoping elements moving apart during its use by the batter. Further, this apparatus does not provide any measurement information to the batter to instruct him where he should stand in relation to home plate.

All of these prior art devices are used to position the batter in relation to home plate but none of these devices use a measurement based upon the size of the individual batter to determine a point located in the strike zone of the batter and use that measurement to position the batter at a proper distance from home plate. Further, none of the prior art devices allow easy to use incremental adjustment of the foot positions in relation to home plate without any adjustments of the training device.

The training device of the present invention is a simple, easy to use system, which has been designed to teach novice batters, particularly young children, the basics of proper batting techniques. The training device provides these novice batters with a system to teach proper batting techniques, which are easy to duplicate time after time, thus providing the batter with the necessary repetition of these techniques to allow these batters to successfully hit the ball. The present training device is so simple that it can be used by the child without adult supervision once the first foot positioning or first measurement has been made.

SUMMARY OF THE INVENTION

The present invention provides a training device for teaching a baseball batter to utilize a proper batting position to hit a ball with a bat.

The present invention additionally provides a training device that measures a point located in the strike zone of a batter that in turn instructs the batter where to stand to have a proper distance in relation to home plate so that the batter will be positioned to have the opportunity to hit the ball with a level swing of the bat with the "power zone" of the bat utilizing a full arm extension with the leading arm.

The present invention additionally provides a training device that can be used with a batting Tee to correctly determine the height within the strike zone the batting Tee should be set for each batter to achieve a proper batting stance and to stand at a proper distance from the batting Tee to have the opportunity to hit a ball off of the batting Tee.

The present invention further provides a training device that can be used to properly position a batter to hit a pitched ball.

The present invention is equally applicable to teach proper batting techniques for baseball and softball.

Applicant's present invention provides a simple training device which is a mat marked with a first indicia designating home plate and a plurality of second indicia showing sequential segments for the batter to place his feet. The mat may be used alone or with at least one measuring means to measure a specific distance perpendicular from the mat which represents a point located in the strike zone of the batter, which then correlates to a position on the sequential segments on the mat where the batter then places his feet.

Novice batters must be constantly reminded of the basics of batting techniques, such as how to stand, where to stand, where the ball should be when hit, how the bat should be held, and where on the bat the ball should make contact. The mat of the present invention provides a novice batter with a simple, easy to use device which teaches the batter how far apart his feet should be to achieve a proper batting stance, and to position his feet parallel to each other and pointing toward and thus "squared" with home plate. A coach or parent spends a considerable amount of time during practice repeating this information when this time could be more wisely spent teaching the more complex issues of batting, such as the elements of the swing. The present training device provides this information in an efficient, easy to grasp system for the novice batter to follow on his own thus allowing the coach or parent time to teach these other complex techniques. If the training device is used with a batting Tee, the batter can be initially instructed on the use of the training device and then he or she can practice without coach or parental supervision.

When the mat of the present invention is used in conjunction with a means of measuring a specific distance to a point located in the strike zone for each individual batter, this training kit combines the proper positioning of the feet to each other and to home plate provided by the mat, with correlating the specific distance measured by the measuring means to the proper distance this batter should stand in relation to home plate. This proper distance enables the batter to hit the ball with a level swing of the bat with the "power zone" of the bat using a full arm extension with the leading arm. The specific perpendicular distance measured upwardly from the mat generally is the middle of the strike zone for each individual batter.

The training kit teaches a novice batter the most strategic position for the batter to stand to increase the percentage of hitting the ball with the portion of the bat, known as the "power zone". The "power zone" is the barrel, thicker portion or the "meat" of the bat that should make contact with the ball if the ball is to be hit well. Batting stance and the location of the ball when it is hit by the batter are essential elements to be mastered to become a successful batter. Use of the training device of the present invention prepares the novice baseball batter to hit the ball by providing important information regarding the batting stance and where the batter should position himself before he ever hits the ball.

When learning a new skill, it is important to teach the muscles used in the skill what to do. This phenomenon, known as muscle memory, occurs as the neurons travel down the pathway to initiate a particular movement; and through repetition this pathway becomes worn. Each time the impulse is sent from the brain to initiate that particular movement, that same worn pathway will most likely be used. Thus, the more that a batter duplicates a particular batting skill correctly and consistently, the more likely the batter will hit the ball properly. This consistent hitting using proper batting techniques builds confidence and makes the novice batter a successful hitter providing him or her with a greater desire to continue the sport. The training mat and training kits of the present invention containing the training mat in combination with other measuring elements provide the batter with tools to duplicate proper techniques each time at bat which is necessary to attain successful consistent batting skills.

DETAILED DESCRIPTION OF THE PREFERRED EMBODIMENT

The present invention will now be described in detail with specific reference to FIGS. 1–8, which are examples of the preferred embodiments of the present invention. While the invention will be described in detail in conjunction with these embodiments, it will be understood that they are not intended to limit the invention to those particular embodiments. The figures show elements of the present invention which are segmented in sequential order and represented as numbered segments. These numbered segments are merely representative of the preferred embodiments because the preferred embodiments employ colored segments which are not possible to show in the figures. The numbers are to represent correlated segments (14*a*), (14*b*), (22) and (24) on different elements of the present invention. Likewise, the segmented tape measure (24) preferably is a cord with colored segments. As discussed above, it is not possible to show colored segments; and additionally, it is not possible to display numbers on a cord. Therefore, a flat tape with numbers is utilized to show this embodiment.

Figure 1:
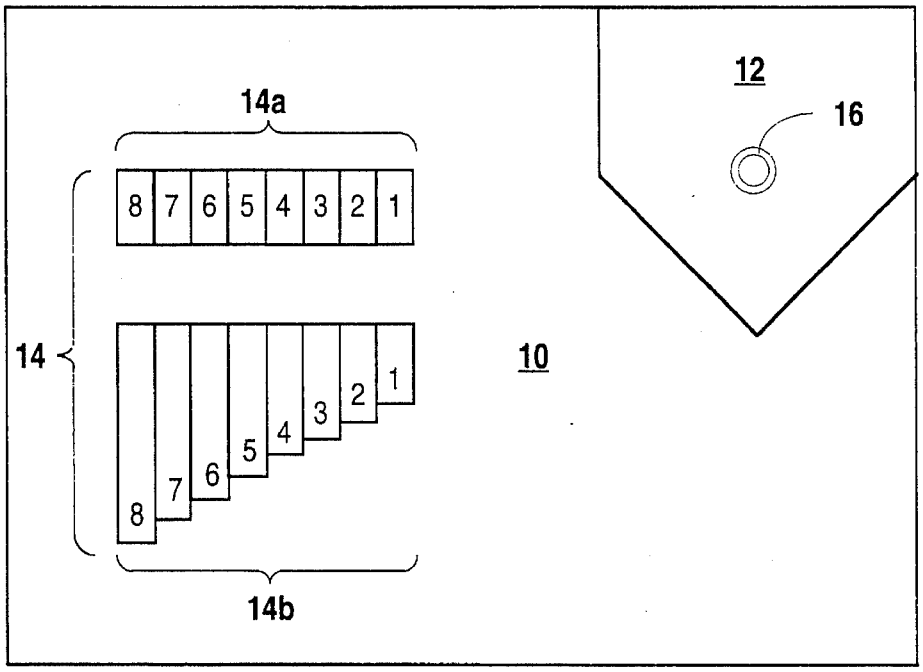
FIG. 1 is a top view of the batting training mat of the present invention.

FIG. 1 discloses a top view of the mat (10) used in the present invention to teach a baseball batter to utilize a proper batting position. The mat (10) has a first indicia (12) for designating home plate; and a plurality of second indicia (14) sequentially located for correctly positioning the batter relative to the first indicia (12). Preferably as shown in FIG. 1, the plurality of second indicia (14) are composed of a first segmented component (14*a*) for positioning the leading foot of the batter; and a second segmented component (14*b*) for positioning the trailing foot of the batter. Each of the segments in the first segmented component (14*a*) has a corresponding segment in the second segmented component (14*b*). Each of the corresponding segments of the first (14*a*) and the second (14*b*) segmented components represented by numbers in the figures, are the same distance from the first indicia (12). The number of segments in the first segmented component (14*a*) and in the second segmented component (14*b*) can be as few as four; however, preferably there are between eight to ten segments with each segment preferably being two inches wide.

The plurality of second indicia (14) can alternately be configured as a plurality of continuous segments which are not divided as shown in FIG. 1, but rather each segment can be one laterally continuing segment for positioning the feet of the batter at a particular distance from the first indicia (12).

The mat (10) is made of a clear material, preferably a polymeric sheet material. Different types of polymeric material can be used in combination to produce the mat (10) of the present invention; and those polymeric materials appropriate for making this type of mat (10) are known to persons skilled in the art. The polymeric material should be thick enough to withstand the wear and tear of batters standing on it without moving, yet be flexible enough to allow it to be rolled up for storage. Preferably, the mat (10) is made with one piece of clear polymeric material with the first indicia (12) designating home plate and the plurality of second indicia (14) being made of different or the same polymeric material. Or the mat (10) can be made with one piece of clear polymeric material with the first indicia (12) designating home plate and the plurality of second indicia (14) laminated to one of the sides. Or alternatively, the first indicia (12) and the plurality of second indicia (14) is placed between two pieces of clear polymeric material and then these two pieces are laminated together. When the mat (10) is laid on the ground on one side, it can be used for a right-handed batter and when it is laid on the ground on the other side, it can be used for a left-handed batter. At a position in the center of the first indicia (12) is a means (16) for attaching an element to the mat (10). This attachment means (16) can be an opening, a grommet, a snap, a fastener, or any other type of means to which an element can be removably attached, and which is well known to persons skilled in the art.

The first indicia (12) for designating home plate is the shape of home plate and is a distinctive color which emphasizes the location of home plate to the batter. Likewise, the plurality of the second indicia (14), are preferably defined by individual, different colored segments indicating separate positions for foot placement. One of the colored segments of the first segmented component (14*a*) correlates to one segment of the same color in the second segmented component (14*b*) because each of these correlated segments are at an equal distance from the first indicia (12). Correlation by color indicia is the preferred method to indicate foot placement positions for the leading and trailing feet of the batter, but other indicia, such as numbers or other type of characters, can also be used and are intended to be encompassed by the present invention. FIG. 1 shows the correlating segments by numbers for representative purposes only and should not be construed as the preferred embodiment.

The segments of the first (14*a*) and second (14*b*) segmented components are presented by strips of color but these segments could alternatively be represented by sequential foot shaped patterns. Or the segments of the first (14*a*) and second (14*b*) segmented components could additionally include sequentially outlined footprints on all or some of the segmented components to show where the feet should be placed on the segments.

The first segmented component (14*a*) for positioning the leading foot of the batter and the second segmented component (14*b*) for positioning the trailing foot of the batter are preferably separated by a distance to show the batter that his feet should be separated in a proper batting stance. As shown in FIG. 1, the length of the segments of the first segmented component (14*a*) are preferably all four inches in length, whereas the length of the segments of the second segmented component (14*b*) increases as each segment is farther from the first indicia (12). This increasing length provides foot positioning guidance to the batter to use a wider stance as the batter stands farther from the first indicia (12). This is so because a taller batter would stand further away from home plate and have a wider stance.

To use the mat (10) shown in FIG. 1, the mat (10) is laid on the ground; and if on a baseball field, the mat (10) can be laid directly on home plate matching the first indicia (12) with home plate. The batter places the leading foot on the first segmented indicia (14*a*) and the trailing foot on the second segmented indicia (14*b*) with his feet pointing toward and "squared" to the first indicia (12). With the help of a coach or parent or on his own, the batter then determines a good position from the first indicia (12) where he should stand. When this position is selected, the batter then looks down at the first (14*a*) and the second (14*b*) segmented components to see where his feet are positioned; and for example, notes that his leading foot is on segment No. 3 of the first segmented component (14*a*) and his trailing foot is on segment No. 3 of the second (14*b*) segmented component. During batting practice, each time the batter comes to bat, he will continue to position himself on both of the segments No. 3, thus providing the duplication necessary to correctly position himself by demonstrating the proper batting fundamentals necessary to achieve batting consistency.

An important use for the mat (10) of the present invention is in conjunction with a batting Tee. Tee ball as discussed above, is generally a young child's earliest introduction to the sport of baseball. And even though the novice batter hits the ball off of the Tee, the novice batter still needs instructions in regard to where he or she should stand in relation to the Tee to hit the ball.

The present inventors have determined that when the mat (10) is used in conjunction with a batting Tee that is marked with colored segments in the same order as the colored segments of the plurality of second indicia (14), the batter is able to specifically position himself on the colored segments on the mat (10) which correspond to the height measured by the batting Tee. This more precise foot positioning on the mat provides the batter with the opportunity to hit the ball with a level swing of the bat with the "power zone" of the bat using a full arm extension of the leading arm on a consistent basis. The batter adjusts the batting Tee to a height equivalent to his own hip level, which is generally the middle of the strike zone for the batter. The batter then stands on the same colored segment which has been identified by the batting Tee, which places the batter at a proper distance from the first indicia (12). This proper distance is equal to the distance measured by the batting Tee minus the height of the lip or top (44) of the batting Tee.

Figure 2:
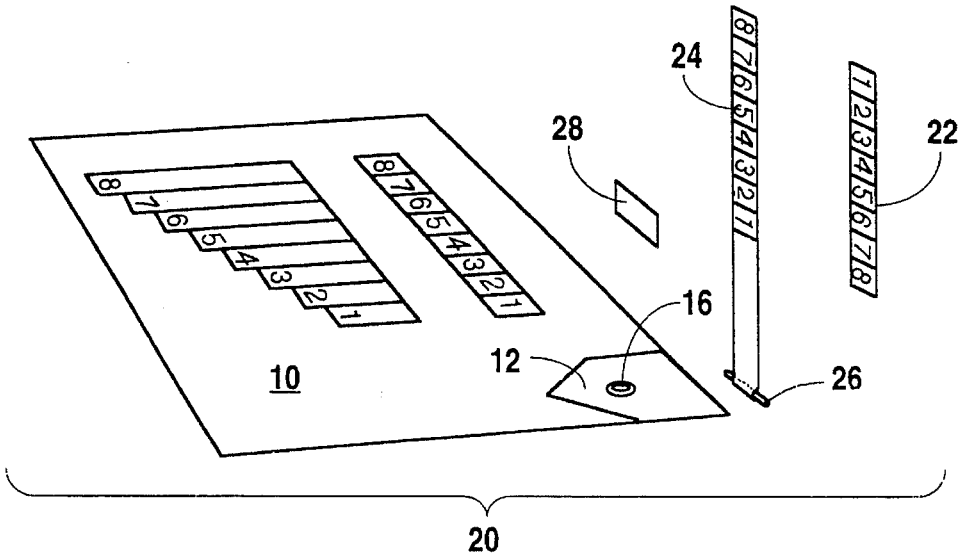
FIG. 2 is a perspective view of one of the training kits of the present invention.

The mat (10) of the present invention as shown in FIG. 1 can be utilized as an element of the training kit (20) shown in FIG. 2 for use in conjunction with a batting Tee for teaching a baseball batter to utilize a proper batting position to hit a ball with a bat. In its simplest form, the kit (20) includes the mat (10) having a first indicia (12) for designating home plate, and a plurality of second indicia (14) sequentially located for correctly positioning the batter relative to the first indicia (12). Additionally, the kit (20) includes a plurality of third indicia (22) for attachment to a batting Tee in a specific order. Kit (20) does not have a batting Tee as one of its components because many coaches and parents already have a batting Tee. The third indicia (22) included in the kit (20) can be attached in a specific order at a specific location to any batting Tee as long as the batting Tee is an official batting Tee sanctioned by the Little Baseball League, Inc. which is the type of batting Tee shown as (32) in FIG. 4.

Figure 4:
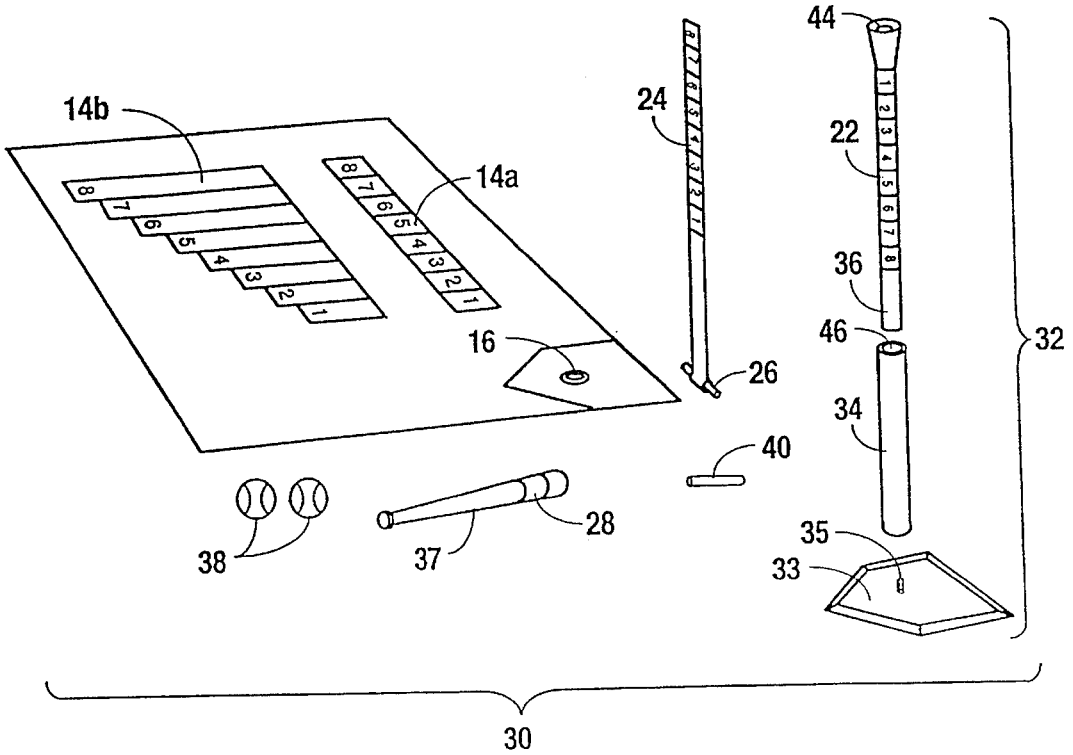
FIG. 4 is a perspective view of an alternate training kit of the present invention.

The batting Tee (32) shown in FIG. 4 will be utilized as the example for attaching the plurality of third indicia (22) to a batting Tee even though batting Tee (32) in FIG. 4 already has the plurality of third indicia (22) attached. Batting Tee (32) is composed of a base (33) having a home plate shape from which a hollow support tube (34) extends perpendicularly upward from the center (35) of the base (33). An inner sliding tube (36) capable of holding a ball, is telescopically engaged within the support tube (34). To use the plurality of third indicia (22) of kit (20), the plurality of third indicia (22) are attached to the inner sliding tube (36) of batting Tee in a specified order at a specific distance from the top (44) of the inner sliding tube (36) of the batting Tee (32). Generally, for a small official batting Tee, this location would be directly below the top (44) of the batting Tee, as exemplified by batting Tee (32) in FIG. 4. The order of the plurality of third indicia (22) to be attached should be the same as the order of the segments of the plurality of second indicia (14) on the mat (10). The number of third indicia (22) correspond in number and width to the segments of the plurality of second indicia (14). After the plurality of the third indicia (22) have been attached to a batting Tee, the batting Tee used with training kit (20) will be the same as the batting Tee (32) of FIG. 4. Each of the third indicia (22) should correspond in width to the width of the segments of the first (14*a*) and second (14*b*) segmented components, preferably 2 inches wide. The plurality of third indicia (22) can be attached to any official batting Tee and any batting Tee where the sliding tube slides inside the support tube as exemplified in FIG. 4.

The plurality of third indicia (22) must be durable and firmly attachable so that the plurality of third indicia (22) remain attached to the inner sliding tube (36) as it is continuously slid up and down in the support tube (36) of the batting Tee. The tape may be single portions of attachable tape, such as vinyl tape, with each portion of tape designated by a different color, number or character but preferably the plurality of third indicia (22) are be composed of a single portion of tape containing each of the third indicia (22) as shown in FIG. 2. The length of the plurality of the third indicia (22) preferably is 16 inches in length, containing 8 different 2 inch wide segments. The tape may be of a width sufficient to wrap around the entire circumference of the second tube or less than that width. It is only necessary that a portion of the tape on the batting Tee be visible to the batter.

Once the plurality of third indicia (22) have been attached to the batting Tee as shown by the batting Tee (32) in FIG. 4, the batting Tee is then placed on the first indicia (12) designating home plate of the mat (10) and is ready to measure a point in the strike zone for the batter.

The training kit (20) also includes a segmented tape measure (24) which can be attached to the center of the first indicia (12) of the mat (10), and can also be used to measure a point in the middle of the strike zone for the batter, and is a more convenient measuring means when the batter is not using a batting Tee. The segmented tape measure (24) contains segments as does the batting Tee (32), which are also correlatable in number, width and color, number or character to the segments of the plurality of second indicia (14) on the mat (10). Preferably, the segmented tape measure is a cord containing colored segments of equal width to the segments of the plurality of second indicia (14) on the mat (10).

Figure 3:
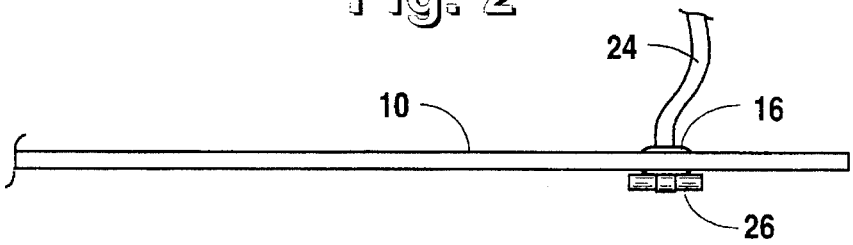
FIG. 3 is a side view of the training mat of the present invention with the attachment of the segmented tape measure.

As shown in FIG. 3, the segmented tape measure (24) can be attached to the mat (10) at the attachment means (16) by inserting a fastener (26), which is attached to one end of the segmented tape measure (24), through the attachment means (16) and securely engaging the segmented tape measure (24) to the attachment means (16).

The training kit (20) may also include a fourth indicia (28) which is for attachment to a bat for indicating a point of contact with a ball. The fourth indicia is approximately 8 to 12 cms in length and sufficiently wide enough to wrap around the circumference of the bat beginning approximately 6 cms from the tip of the bat and covering the "power zone" of the bat.

FIG. 4 discloses a complete training kit (30) for teaching a baseball batter to utilize a proper batting position to hit a ball with a bat, which includes the mat (10) and the batting Tee (32) to which the plurality of third indicia (22) have already been attached. The batting Tee (32) is designed for measuring a specific distance perpendicular from the mat (10), which is a point located in the strike zone of the batter. The plurality of third indicia (22) attached to the batting Tee (32) are the same as discussed in regard to the training kit (20). As discussed above, in regard to the training kit (20), each of the plurality of third indicia (22) attached to the batting Tee (32) are also correlatable in number, width, and color, number or character to the segments of the plurality of second indicia (14) on the mat (10). Alternatively, the segments of the plurality of third indicia (22) could be painted directly onto the inner sliding tube (36) of the batting Tee (32) rather than applied to the batting Tee as tape.

The training kit (30) also includes a bat (37) having a fourth indicia (28) for indicating a point of contact with a ball (38) at the "power zone" of the bat and two balls (38) and a marking means, such as chalk (40) for marking the balls (38). When a ball (38) marked at its "sweet part", which is the narrowest distance between the stitching on the ball, and is hit by the bat (37), the fourth indicia (28) on the bat (37) shows a point of contact between the ball (38) and the bat (37). The training kit (30) can alternatively include the fourth indicia (28) for attachment to a bat as discussed in regard to the training kit (20), for indicating a point of contact with a ball rather than the bat (37) with the fourth indicia (28) already attached to the bat.

The training kit (30) also includes a segmented tape measure (24) which can be attached at the attachment means (16) to the center of the first indicia (12) of the mat (10) as discussed above. The segmented tape measure (24) can also be used to measure a point in the middle of the strike zone for the batter. The segmented tape measure (24) contains segments as does the batting Tee (32), which are also correlatable in number, width, and color, number or character to the segments of the plurality of second indicia (14) on the mat (10).

The training kits (20) and (30) can both be used in conjunction with the batting Tee (32) to which the plurality of third indicia (22) have been attached to measure a specific distance perpendicular from the mat (10), which is a point located in the strike zone of the batter (42). To use the batting Tee (32) to measure this point, the batter (42) stands next to the batting Tee (32) and the inner sliding tube (36) is adjusted by sliding it up and down within the support tube

Figure 5:
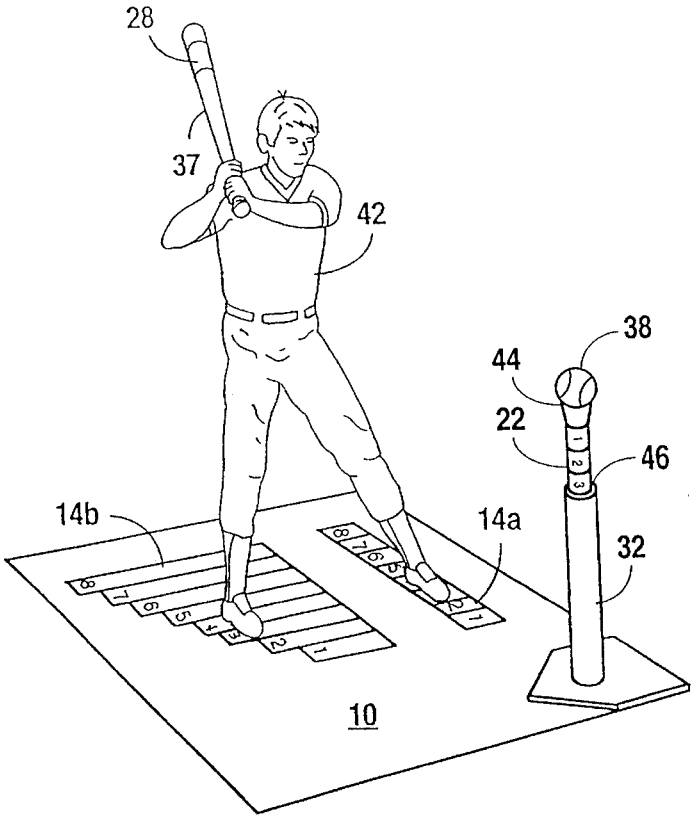
FIG. 5 is a perspective view of a batter using one of the training kits of FIGS. 2 or 4.
Figure 8:
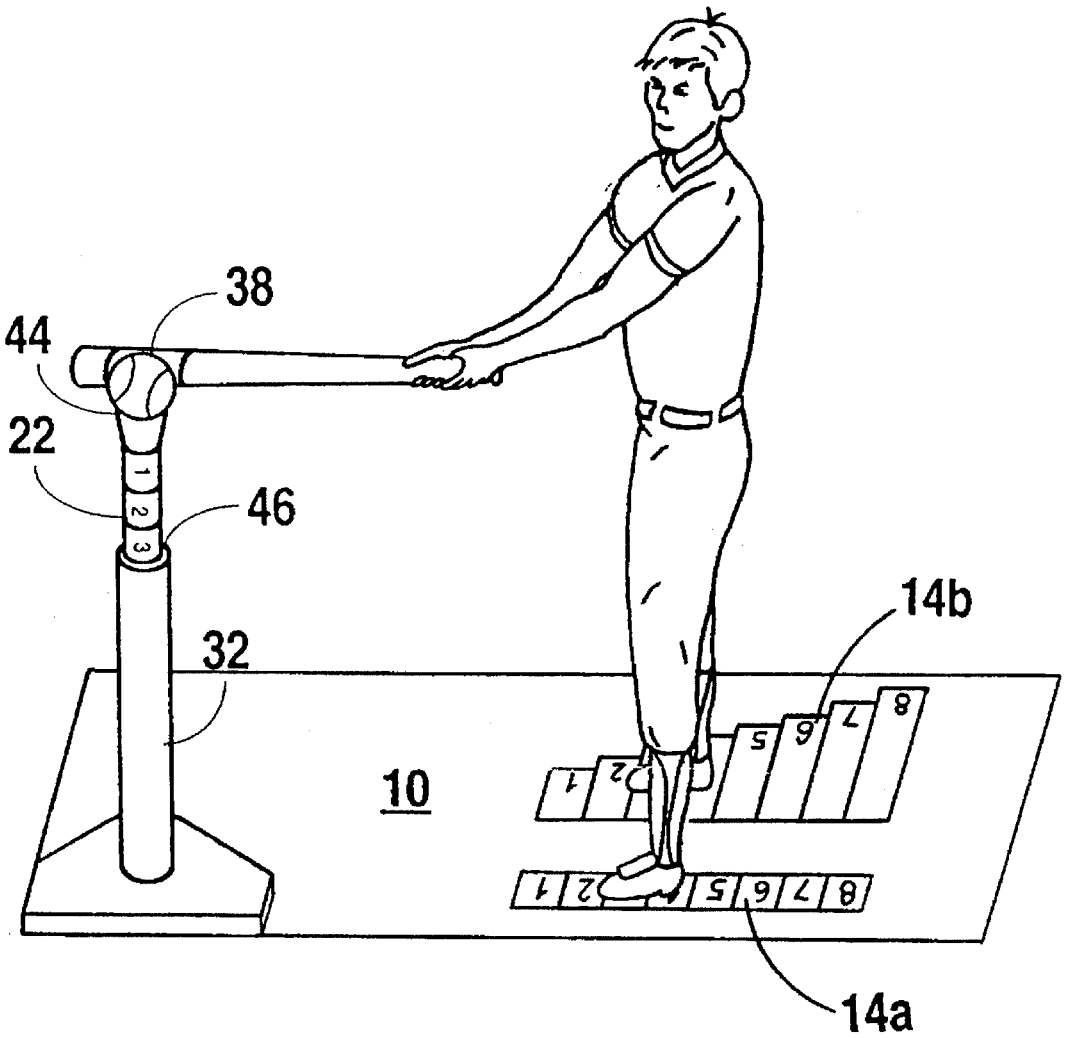
FIG. 8 is a perspective view of a batter during a swing using one of the training kits of FIGS. 2 or 4.

(34) until the top (44) of the batting Tee (32) is at the batter's (42) iliac crest or hip level, which is the height equivalent to a point located in the middle of the strike zone for the batter (42). The ball (38) is then placed on the top (44) of the batting Tee (32). The batter (42) then identifies the segment of the plurality of third indicia (22) which is in contact with the top (46) of the support tube (34) of the batting Tee (32) with the inner sliding tube (36) telescoping into the support tube (34) at this measured height. The batter (42) then places his leading and trailing feet on the corresponding segments of the first (14*a*) and second (14*b*) segmented components on the mat (10). For example, as shown in FIG. 5, if segment No. 3 is identified on the batting Tee, then the batter (42) stands on segments No. 3 of the first (14*a*) and second (14*b*) segmented components. The specific distance perpendicular from the mat (10), measured by the batting Tee (32) to the hip level of the batter (42) is equal to the distance from the center (35) of the base (33) of the batting Tee (32) to the corresponding numbered segments of the first (14*a*) and second (14*b*) segmented components minus the height of the top (44) of the batting Tee (32). The batter (42) then positions himself in a batting stance as shown in FIG. 5 and hits the ball off of the batting Tee (32) as shown in FIG. 8.

Figure 6:
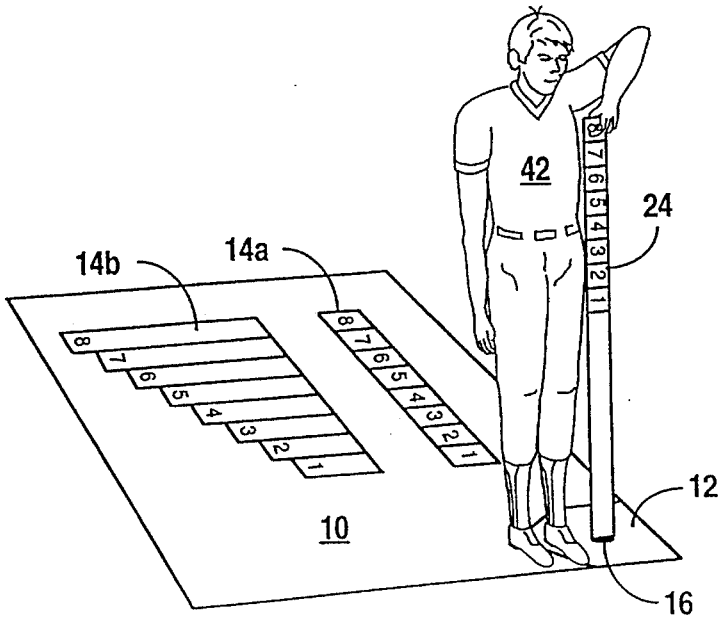
FIG. 6 is a perspective view of an alternate training kit of the present invention.

Either of the training kits (20) and (30) can use the alternative means in place of the batting Tee (32) for measuring this point in the strike zone of the batter by using the segmented tape measure (24) which is attached to the center of the first indicia (12) of the mat (10) via attachment means (16). FIG. 6 discloses the use of the mat (10) to which the segmented tape measure (24) has been attached at attachment means (16) on the first indicia (12) to measure the point located in the strike zone for the particular batter (42). As with the batting Tee (32), the segmented tape measure (24) is used to measure the distance to the batter's hip level. The segment of the segmented tape measure (24) which is at the hip level of the batter when held up to the batter (42) as shown in FIG. 6 correlates to one of the plurality of second indicia (14) and indicates the proper distance, which is equal to the distance measured to the hip level of the batter (42) minus 1 inch (for the reasons explained in more detail below), which the batter (42) should stand from the first indicia (12) to attain the proper batting position.

Figure 7:
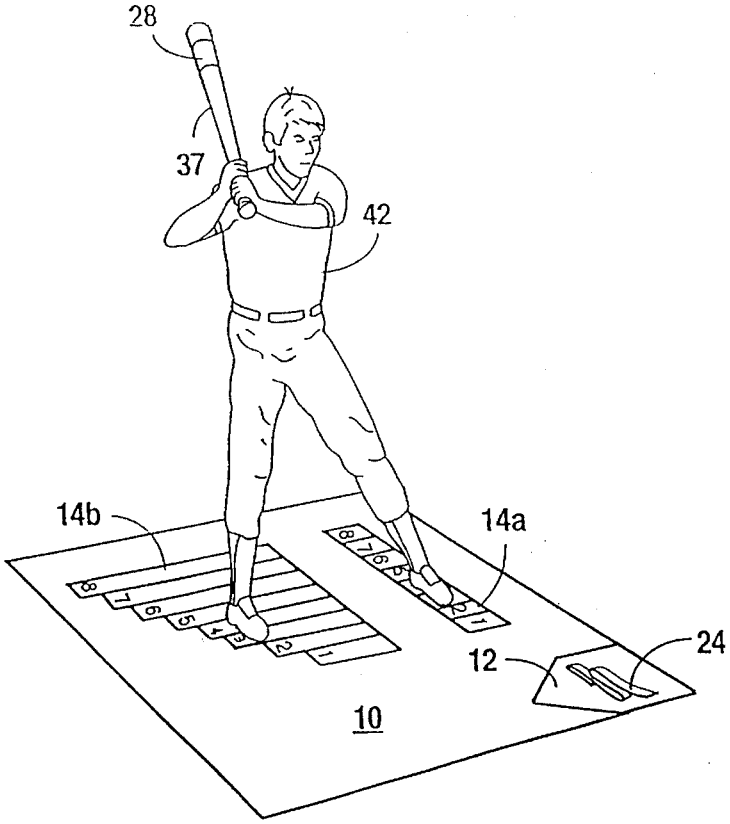
FIG. 7 is a perspective view of a batter using the training kit of FIG. 6.

Use of the segmented tape measure (24) is especially convenient to determine proper batting position when the batter (42) is going to hit a pitched ball as shown in FIG. 7. The segmented tape measure (24) provides the same type of measurement as the batting Tee (32) provides; that is, measuring a point in the strike zone of the batter. This is so because the unsegmented portion of the tape measure (24) is the same length as the batting Tee (32) at its completely compressed position. The present inventors have determined that when a mat (10) with segment No. 1 of the first (14*a*) and second (14*b*) segmented components of the plurality of second indicia (14) located at a distance equal to the height of the batting Tee (32) in it completely compressed position minus the height of the top (44) of the batting Tee (32) is utilized, the batter is properly positioned at a corresponding distance to have the opportunity to successfully hit the ball. For example, this distance for a standard small size official batting Tee (32) as exemplified in FIGS. 4, 5 and 8 is approximately 20 inches measured from the base (33) to the top (44) when the batting Tee (32) is in its completely compressed position. The length of the inner sliding tube (36) beginning directly below the top (44) where the top of the first segment No. 1 begins to the base (33) is 19 inches; and the height of the top (44) of the batting Tee (32) is approximately 1 inch. Thus, a mat (10) for use with this size batting Tee (32) would have segment No. 1 of the first (14*a*) and second (14*b*) segmented component located 19 inches from the middle of the center (35) of the batting Tee (32), when the batting Tee (32) is placed directly on the first indicia (12) of the mat (10). These exact measurements are given only to provide specific information about the preferred embodiments in regard to the correlation between the specific distance measured perpendicular from the mat (10) and the proper distance the batter should stand from the first indicia (12) on the mat (10). There can be some variation in the height of the tops (44) of batting Tees but generally the tops are approximately 1 to 1.5 inches in height. The length of 20 inches for the unsegmented portion of the segmented tape measure (24) for the preferred embodiment was selected to be used as an interchangeable measuring means for the standard small official batting Tee as described herein. However, the fact that the individual segments in the first (14*a*) and second (14*b*) segmented components, the plurality of the third indicia (22) and the tape measure (24) are each preferably 2 inches wide provides for an allowable margin of variation in foot positioning of the batter. Likewise, the strike zone and even the middle of the strike zone is not an exact point for each batter but also can tolerate some allowable margin of variation and yet still be considered in the strike zone.

The distance to the middle of the strike zone of the batter can be measured by the segmented tape measure (24) rather than the batting Tee (32). The length of the unsegmented portion of the tape measure (24) is approximately 20 inches and is the same as the height of a small official batting Tee at its completely compressed position. The tape measure (24) and the batting Tee (32) provide the same information to the batter (42) regarding foot positioning on the mat (10) because the distance to segment No. 1 of the first (14*a*) and second (14*b*) segmented components of the plurality of second indicia (14) on the mat (10) is 19 inches, which when used with the tape measure (24) is equivalent to the 20 inch distance on the unsegmented portion of the tape measure (24) minus 1 inch because 1 inch is approximately the height of the top (44) of the batting Tee (32).

By providing both means for measuring the point in the strike zone of the batter, the various training kits provide the versatility and ease of use with or without a batting Tee. Even the mat (10) in its simplest form provides useful information to a novice batter to consistently attain proper foot positioning in relation to home plate to hit a pitched ball or a ball off of a batting Tee. The mat (10) used in combination with the batting Tee (32) or the segmented tape measure (24) further provides a more precise means to measure a specific distance perpendicular from the mat (10) which determines a point in the strike zone for each batter which is the optimal position to hit the ball and is generally the middle of the strike zone for the individual batter. This specific distance correlates to a proper distance on the mat (10) which the batter should position himself to make a level swing with a bat and hit the ball with the "power zone" of the bat with a full arm extension of the leading arm. Duplicating this positioning again and again using the training mat (10) and the training kits (20) and (30) of the present invention teaches the novice batter fundamental techniques which will enable the batter to practice this skill correctly and consistently, thus providing the batter with the elements required for successful batting with or without the use of the present invention.

The foregoing description of the preferred embodiments of the present invention was presented for illustrative purposes and not meant to limit the invention to specific forms and combination of components disclosed because various modifications to the disclosed invention are possible in light of the above teachings. The present invention is based upon the relationship of a distance measured to a corresponding distance where the batter should stand from home plate. Even though exact measurements have been provided to completely explain the relationships of these distances, these exact measurements are not meant to limit the present invention to particular preferred embodiments. Rather the scope of the present invention is to encompass all training devices which recognize and provide elements to show the presently disclosed relationship of the strike zone of the batter to the distance that batter should stand in relation to home plate to have the opportunity to successfully hit the ball. The invention is intended to cover alternatives, modifications and equivalents, which may be included within the spirit and scope of the invention as defined by the appended claims.

I claim:

1. A training kit for use in conjunction with a batting Tee for teaching a baseball batter to utilize a proper batting position to hit a ball with a bat, said kit comprising:

a mat comprising:

a first indicia for designating home plate; and a plurality of second indicia sequentially located for correctly positioning said batter relative to said first indicia; and a plurality of third indicia for attachment to said batting Tee in a specific order, wherein said batting Tee is adjusted to a height equivalent to a specific distance perpendicular from said mat, said specific distance being the distance to a point located in the strike zone for said batter, wherein said specific distance measured by said batting Tee identifies one of said plurality of third indicia on said batting Tee which correlates to one of said plurality of second indicia and indicates the proper distance said batter should stand from said first indicia to attain said proper batting position.

2. The kit of claim 1, wherein said plurality of third indicia comprises attachable tape.

3. The training kit of claim 1, wherein each of said plurality of second indicia further comprises:

a first segmented component for positioning the leading foot of said batter; and a second segmented component for positioning the trailing foot of said batter.

4. The training kit of claim 1, further comprising a fourth indicia for attachment to said bat for indicating a point of contact with said ball.

5. The kit of claim 3, further comprising a segmented tape measure attachable to the center of said first indicia for measuring a specific distance perpendicular from said mat, said specific distance being the distance to a point located in the strike zone for said batter, wherein one of said segments of said tape measure is correlatable to one of said plurality of second indicia.

6. The kit of claim 5, wherein each of said plurality of third indicia, each of said segments of said segmented tape measure, each of said segments of said first segmented component, and each of said segments of said second segmented component, are designated by correlated colors.

7. A training kit for teaching a baseball batter to utilize a proper batting position to hit a ball with a bat, said kit comprising:

a mat comprising:

a first indicia for designating home plate; and a plurality of second indicia sequentially located for correctly positioning said batter relative to said first indicia; and a batting Tee for measuring a specific distance perpendicular from said mat, said specific distance being the distance to a point located in the strike zone for said batter, said measuring comprising adjusting said batting Tee to a height equivalent to said specific distance, said batting Tee having a plurality of third indicia, wherein said specific distance measured by said batting Tee identifies one of said plurality of third indicia on said batting Tee which correlates to one of said plurality of second indicia and indicates the proper distance said batter should stand from said first indicia to attain said proper batting position.

8. The training kit of claim 7, wherein each of said plurality of second indicia further comprises:

a first segmented component for positioning the leading foot of said batter; and a second segmented component for positioning the trailing foot of said batter.

9. The training kit of claim 7, wherein said plurality of third indicia comprises tape attached to said batting Tee.

10. The training kit of claim 8, wherein each of said plurality of third indicia, each of said segments of said first segmented component, and each of said segments of said second segmented component, are designated by correlated colors.

11. The training kit of claim 7, further comprising a bat having a fourth indicia for indicating a point of contact with said ball.

12. The training kit of claim 11, further comprising at least one ball and at least one marking means for marking said ball and for indicating on said fourth indicia on said bat a point of contact between said ball and said bat.

13. The training kit of claim 7, further comprising a fourth indicia for attachment to said bat for indicating a point of contact with said ball.

14. The training kit of claim 8, further comprising a segmented tape measure attachable to the center of said first indicia for measuring a specific distance perpendicular from said mat, said specific distance being the distance to a point located in the strike zone for said batter, wherein one of said segments of said tape measure is correlatable to one of said plurality of second indicia.

15. The training kit of claim 14, wherein each of said segments of said tape measure, each of said segments of said first segmented component, and each of said segments of said second segmented component, are designated by correlated colors.

16. A training kit for teaching a baseball batter to utilize a proper batting position to hit a ball with a bat, said kit comprising:

a mat comprising:

a first indicia for designating home plate; and a plurality of second indicia sequentially located for correctly positioning said batter relative to said first indicia; and a measuring means for use in conjunction with said mat for measuring a specific distance perpendicular from said mat, said specific distance being the distance to a point located in the strike zone for said batter;

wherein said specific distance measured by said measuring means correlates to one of said plurality of second indicia and indicates the proper distance said batter should stand from said first indicia to attain said proper batting position.

17. The kit of claim 16, wherein each of said plurality of second indicia further comprises:

a first segmented component for positioning the leading foot of said batter; and a second segmented component for positioning the trailing foot of said batter.

18. The kit of claim 17, wherein said measuring means comprises a segmented tape measure attachable to the center of said first indicia, wherein one of said segments of said tape measure is correlatable to one of said plurality of second indicia.

19. The kit of claim 18, wherein each of said segments of said tape measure, each of said segments of said first segmented component, and each of said segments of said second segmented component, are designated by correlated colors.

* * * * *